US006135557A

United States Patent [19]

Gustafsson

[11] Patent Number: 6,135,557

[45] Date of Patent: Oct. 24, 2000

[54] FOLDABLE STOOL

[75] Inventor: Mats Gustafsson, Lidköping, Sweden

[73] Assignee: Multiw Inc., Jacksonville, Fla.

[21] Appl. No.: 09/212,978

[22] Filed: Dec. 16, 1998

Related U.S. Application Data

[63] Continuation-in-part of application No. 08/955,943, Oct. 22, 1997, Pat. No. 5,851,052.

[51] Int. Cl.[7] ..... A47C 4/50

[52] U.S. Cl. ..... 297/344.18; 108/118; 108/147.21; 248/188.5; 248/431; 297/195.11; 297/16.2; 297/451.2

[58] Field of Search ..... 297/16.2, 45, 195.11, 297/344.18, 451.2; 108/118, 147.19, 147.21; 248/164, 188.5, 188.6, 431, 432

[56] References Cited

U.S. PATENT DOCUMENTS 615,476 12/1898 Chapman .
747,204 12/1903 Mock .
772,316 10/1904 Mock .
3,811,455 5/1974 Davis ..... 108/118 X
4,934,638 6/1990 Davis ..... 108/118 X
5,522,642 6/1996 Herrog ..... 297/344.18
5,556,070 9/1996 Viebrock ..... 248/188.5 X
5,876,091 3/1999 Chernomashentsev ..... 297/16.2

*Primary Examiner*—Peter R. Brown
*Attorney, Agent, or Firm*—Fasth Law Offices; Rolf Fasth

[57] ABSTRACT

The foldable stool has a triangular shaped seat with three upper legs attached to the corners of the seat. A leg holder is attached to the bottom portion of each upper leg. Lower legs are inserted into the leg holders. The foldable stool may also have additional leg segments that include a first lower engagement mechanism that is attached to the first lower leg. The first lower engagement mechanism protrudes radially outwardly from the first lower leg and is automatically movable between a lock position and a release position and insertable through the first opening of the first upper leg to lock the first upper leg to the first lower leg. The first lower engagement mechanism has a lower release surface upwardly protruding at a first acute angle relative to the first lower leg and an upper release surface so that the lower release surface and the upper release surface form a second acute angle.

15 Claims, 7 Drawing Sheets

FIG. 9
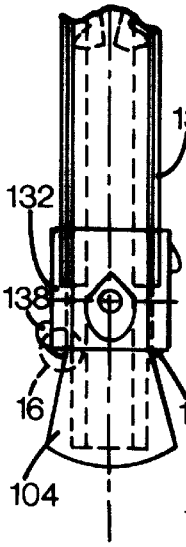
FIG. 16
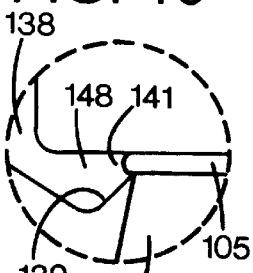
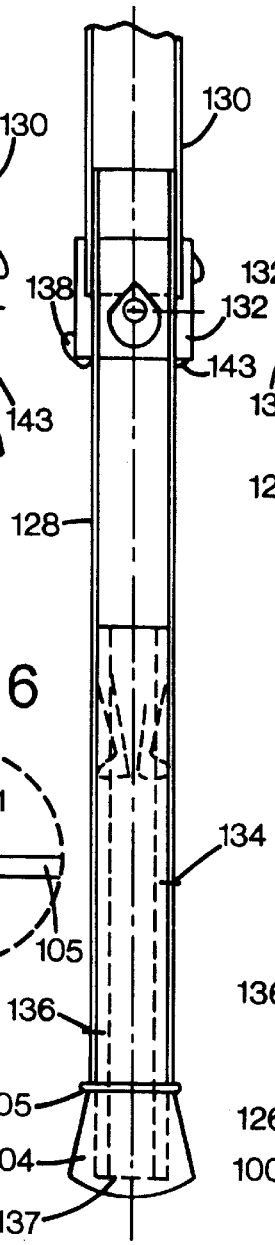
FIG. 10
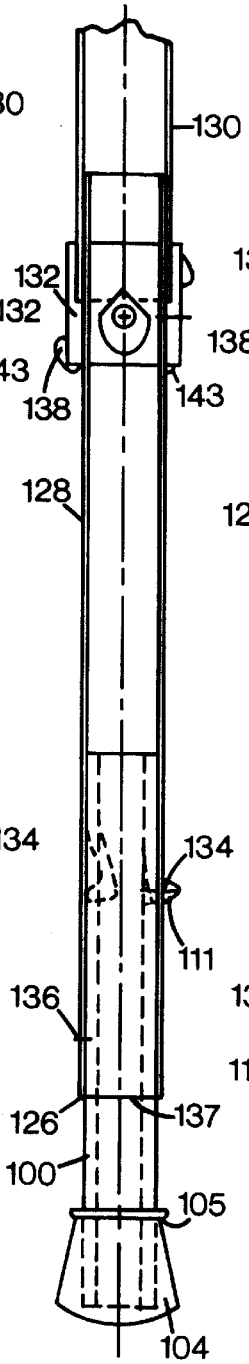
FIG. 11
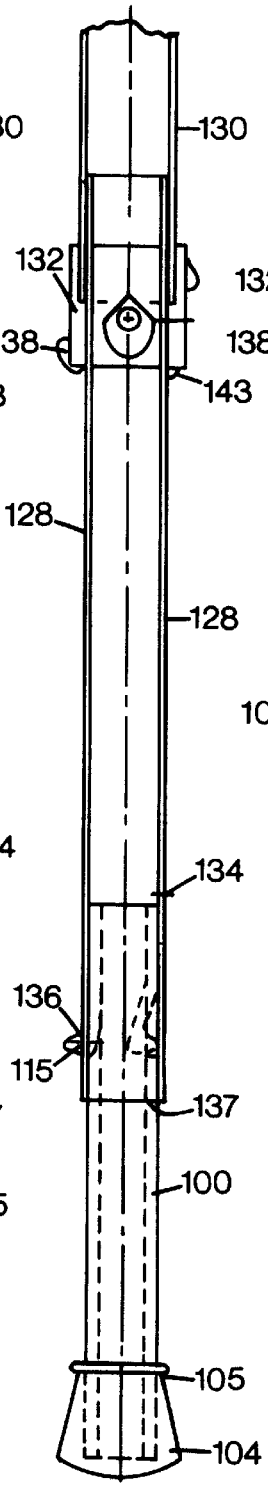
FIG. 12
FIG. 13
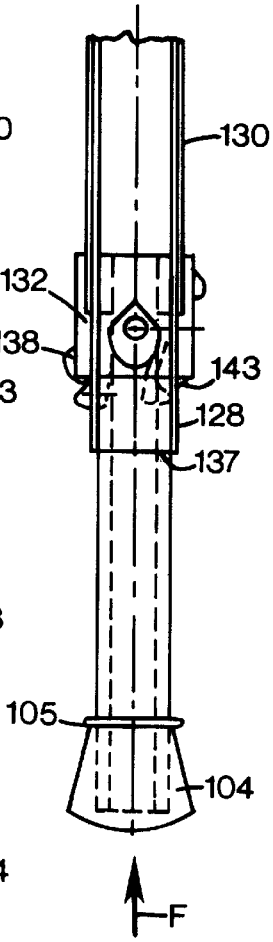

FOLDABLE STOOL

PRIOR APPLICATION

This is a continuation-in-part application of U.S. patent application Ser. No. 08/955,943 filed Oct. 22, 1997 issued as U.S. Pat. No. 5,857,052.

TECHNICAL FIELD

This invention relates to a foldable stool. More particularly, the invention relates to a foldable stool with adjustable legs.

BACKGROUND INFORMATION AND SUMMARY OF THE INVENTION

It is often desirable to have a foldable and portable stool that may be easily transported from one place to another and used in a variety of outdoor conditions. It is also convenient to provide a portable stool that may be reduced to a small size for ease of carrying and storage. Folding stools have been developed in the past. However, the prior art folding stools have been unstable and difficult to fold and unfold. Sometimes, the prior art folding stools have also been heavy and clumsy.

The present invention provides a foldable stool that is stable and very easy to fold into a very small size. The length of the chair legs may be adjusted without pressing any locking mechanism. The foldable stool may be used even if the chair legs are in a contracted or collapsed position. The foldable stool of the present invention can also conveniently be completely disassembled for easy cleaning or storage. The stool of the present invention has a linking mechanism for the legs that has many safety features to prevent any undesirable collapsing of the stool when a person is sitting on the stool. More particularly, the present invention is a foldable stool that has a triangular shaped seat with three upper legs attached to the corners of the seat. A leg holder is attached to the bottom portion of etch upper leg. Each leg holder has a longitudinal opening defined therethrough. The leg holders also define a lateral opening that has an asymmetrical shape. A Y-shaped central connector unit rotatably holds the leg holders together. The connector has irregular shaped extensions that are insertable into the asymmetrically shaped lateral openings of the leg holder when the leg holder is turned into a first position. After the extension is inserted, the leg holder may be rotated into a second position to securely hold the leg holder and so that the upper leg can be inserted into the leg holder and rest on a circular seat or flange that is disposed inside the leg holder. A lower leg may be inserted from the opposite side of each leg holder until a spring biased knob on the lower leg snaps into a second lateral opening defined in the leg holder. When it is desirable to collapse the foldable stool of the present invention, the lower legs may be pushed into the upper leg by pressing the knob to disengage the knob from the leg holder. The upper legs may also be moved together by collapsing the leather seat so that the upper legs are substantially parallel. The upper legs may then be held together in the collapsed position by a strap.

In addition, the foldable stool of the present invention may have additional leg segments that includes a first lower engagement mechanism that is attached to the first lower leg. The first lower engagement mechanism protrudes radially outwardly from the first lower leg and is movable between a lock position and a release position and insertable through the first opening of the first upper leg to lock the first upper leg to the first lower leg. The first lower engagement mechanism has a lower release surface upwardly protruding at a first acute angle relative to the first lower leg and an upper release surface so that the lower release surface and the upper release surface form a second acute angle.

BRIEF DESCRIPTION OF THE DRAWINGS

FIG. 9 is a side view of one of the legs in an inserted collapsed position;

FIG. 10 is a side view of the leg of FIG. 9 in a partially extended position;

FIG. 11 is a side view of the leg of FIG. 9 in a partially extended position;

FIG. 12 is a side view of the leg of FIG. 9 in a fully extended position;

FIG. 13 is a side view of the leg of FIG. 9 in a partially inserted position;

FIG. 16 is a detailed view of section 16—16 of FIG. 9.

DETAILED DESCRIPTION

Figure 1:
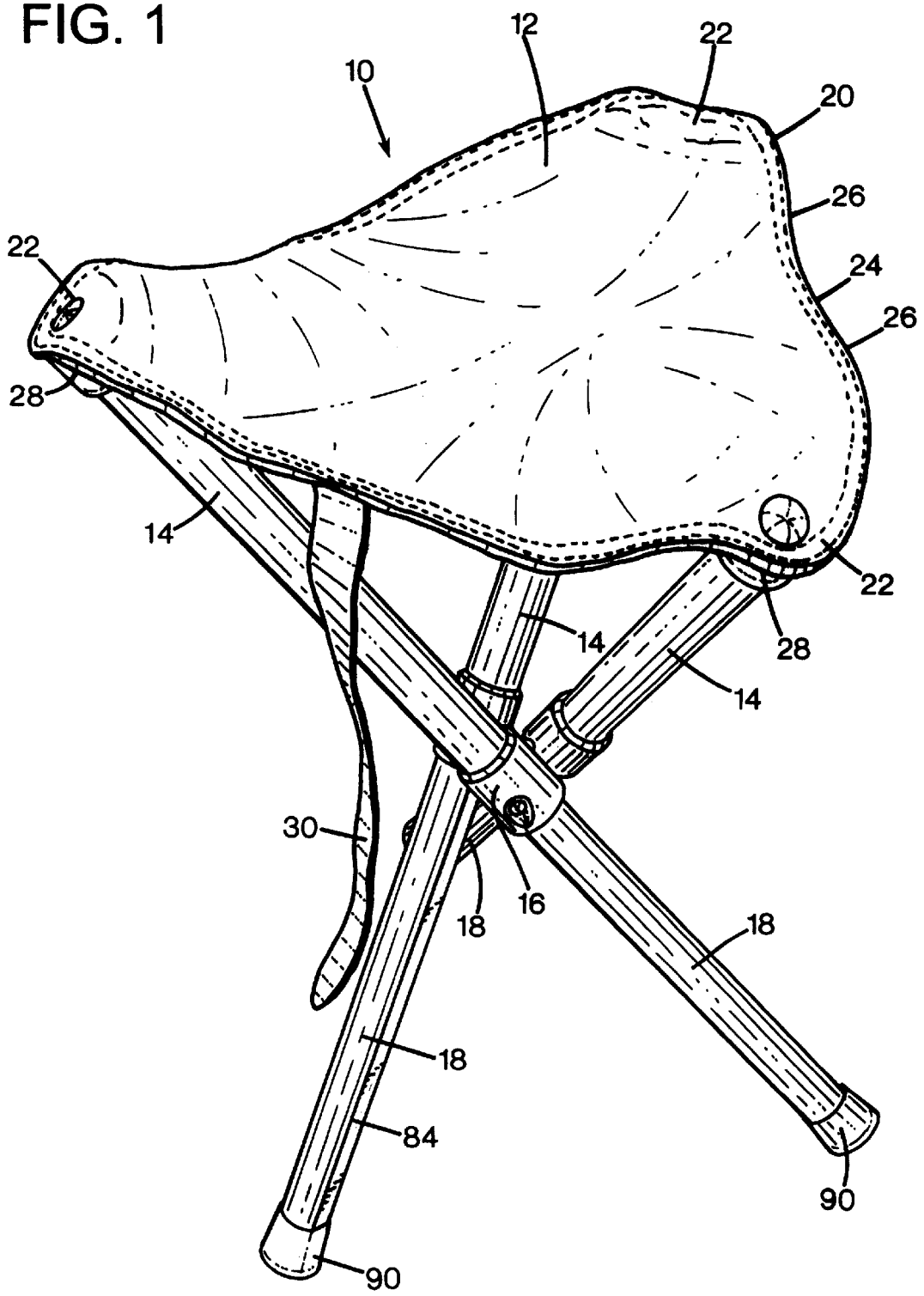
FIG. 1 is a perspective view of the foldable stool of the present invention in an expanded position.
Figure 3:
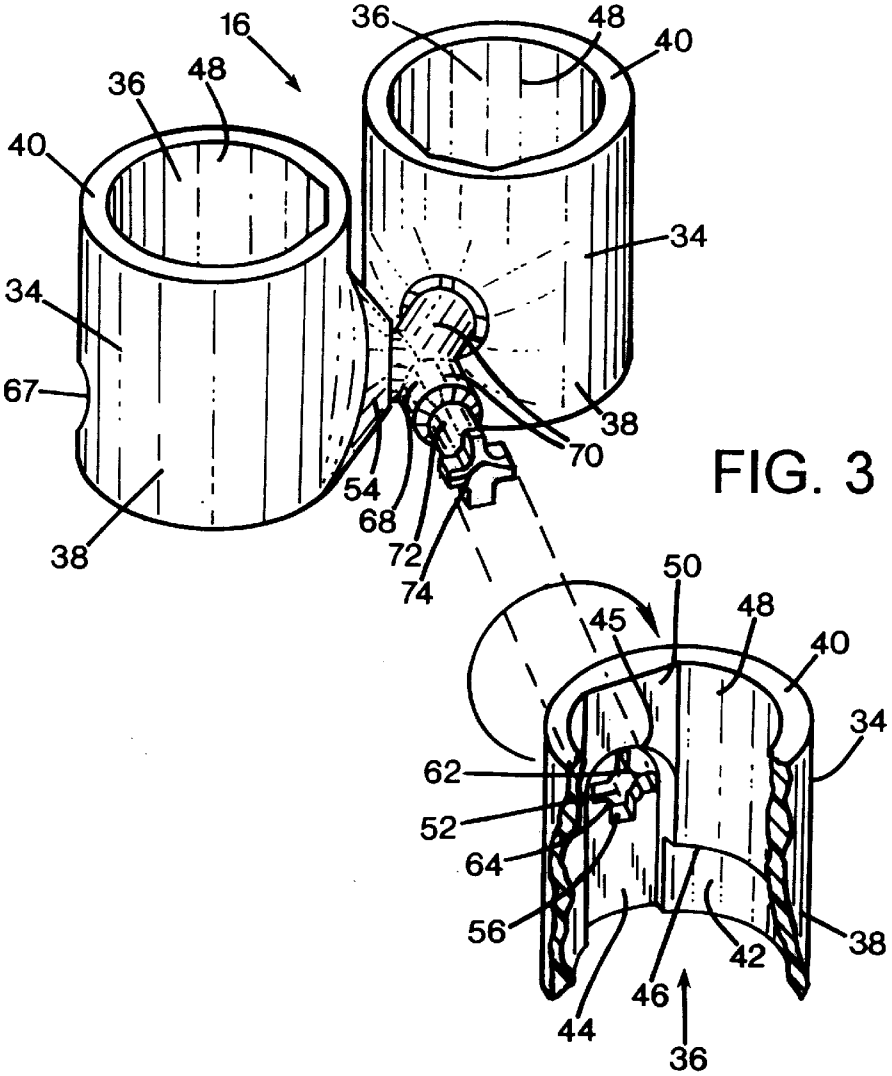
FIG. 3 is a perspective detail view of the linking mechanism of the present invention.
Figure 2:
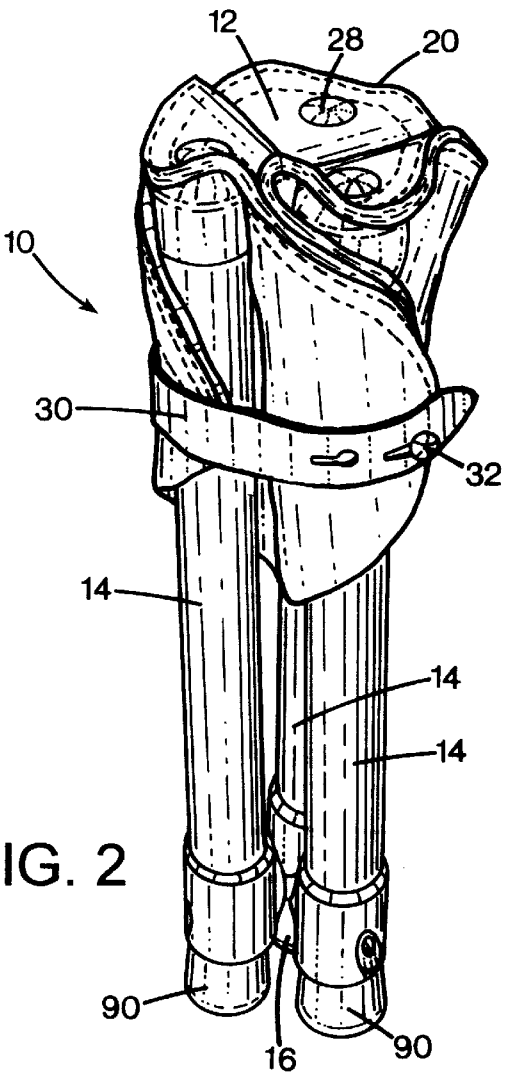
FIG. 2 is a perspective view of the foldable stool in a collapsed position.
Figure 5:
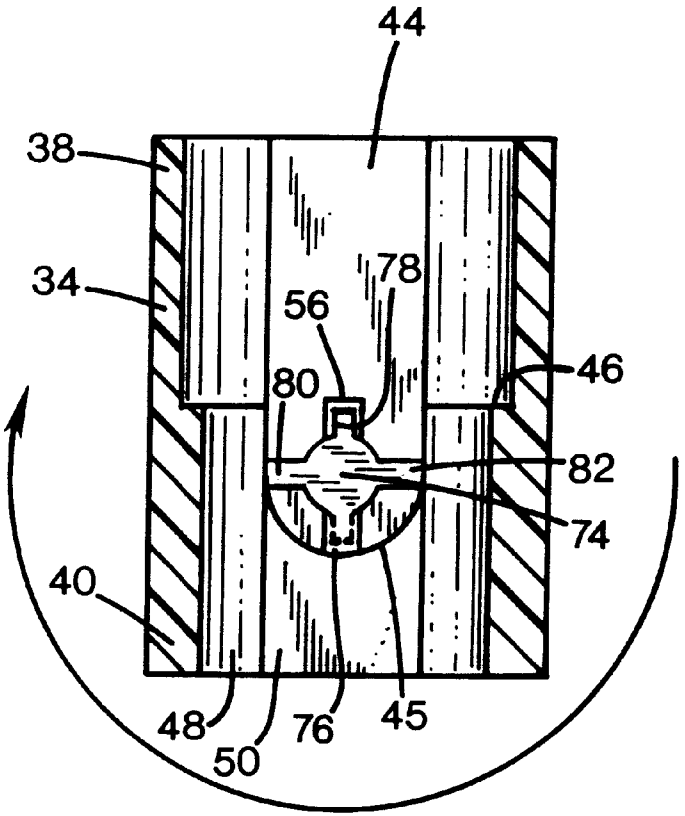
FIG. 5 is a cross-sectional side view of a portion of a leg holder of the present invention.

With reference to FIGS. 1–7, the foldable stool 10 of the present invention has a seat portion 12 attached to three upper legs 14 that are converging towards and connected to a linking mechanism 16. Three lower legs 18 are removably attached to the linking mechanism 16. As described in detail below, the stool 10 may be collapsed from an expanded position, as shown in FIG. 1, to a collapsed folded position, as shown in FIG. 2.

The seat portion 12 is preferably triangular shaped and made of a sturdy flexible material such as a leather material. The seat portion has stitched side edges 20 and corners 22. The side edges 20 may each have a concave midsection 24 and concave side sections 26 disposed between the midsection 24 and the corners 22. Each corner has a plastic cover 28 attached to the seat portion 12. Inside the plastic covers 28 there are leg stabilizers disposed. A strap 30 is attached to the seat portion 12 at one of the side edges 20. The strap 30 has holes defined therein so that a knob 32 that is attached to an underside of the seat portion 12 may be tightly inserted into one of the openings when the stool 10 is in the collapsed position.

The upper legs 14 are preferably hollow cylinders made of a lightweight and strong material such as aluminum. An upper end of the upper legs 14 has a diameter that is dimensioned to tightly fit into the plastic covers 28. A lower end of the upper legs 14 is dimensioned to tightly fit into the linking mechanism 16, as described in detail below.

The linking mechanism 16 comprises three plastic leg holders 34 that are rotatably held together by a connector or joint member 68. Each holder 34 has a longitudinal opening 36 extending therethrough. The holder 34 has an upper end 38 and a lower end 40. The opening 36 at the upper end 38 has an inner wall 42 having a diameter $d_1$ (best seen in FIG. 7) that is designed to snugly receive a bottom end of the upper leg 14. The inner wall 42 may have a plurality of ribs disposed therein to prevent the upper legs 14 from undesirably rotating within the upper end 38. A longitudinal groove 44 is defined in the inner wall 42. The groove 44 ends at a semi-circular end section 45.

The lower end 40 has a diameter $d_2$ that is less than the diameter $d_1$ of the upper end 38 so that a circular flange or seat 46 is formed at a bottom of the upper end 38. The flange 46 supports the upper leg 14 when the upper leg 14 is fully inserted into the leg holder 34 and a person is sitting on the stool 10. In this way, the leg holder 34 not only supports the upper leg 14 but also increases the strength of the upper leg inserted into the leg holder 34. The lower end 40 has a round inner wall section 48 and a flat inner wall section 50. As explained below, the flat section 50 ensures that the lower leg 18 is properly turned before the lower leg can be inserted into the lower end 40.

Figure 6:
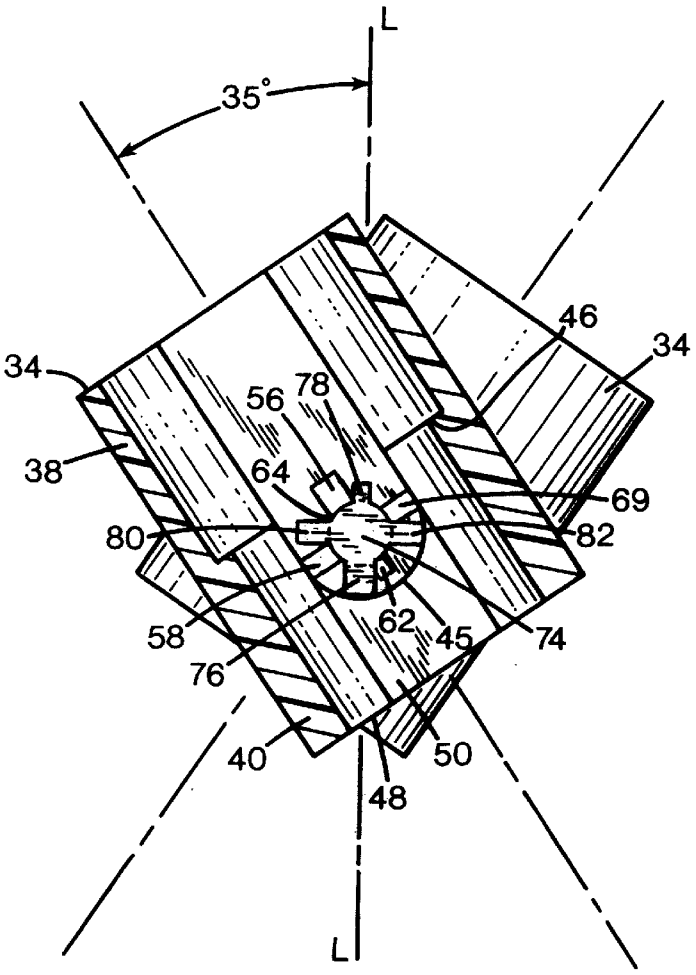
FIG. 6 is a cross-sectional side view of a first leg holder that is turned relative to a second leg holder.

Each leg holder 34 has an asymmetrically shaped lateral opening 52 defined therein. Each lateral opening 52 is defined in a curved protrusion section 54 of the leg holder 34. The lateral opening 52 is irregular because it has a square upper cavity 56 defined at an upper and of the lateral opening 52. The lateral opening 52 has diametrically opposed side cavities 58, 60 and a lower cavity 62. The upper cavity 56 is both longer and wider than the lower cavity 62. The holder 34 has guide members 64 disposed between the cavities that provide an important support when the foldable stool is in the expanded position, as shown in FIGS. 1 and 6.

A second lateral opening 67 is defined on an outside of the leg holder 34. A shallow groove 69 is defined by the holder 34 at the second lateral opening 67 so that it is easy to access the opening 67 with a finger.

A Y-shaped connector or joint member 68 is disposed between the three leg holders 34 to rotatably hold the holders 34 together. The joint member may be made of zinc or any other suitable sturdy material. The joint member 68 has three outwardly protruding extensions 70. The extensions extend outwardly at an angle that is about 120 degrees relative to one another. Each extension 70 has a radial groove 72 disposed therein and a locking mechanism 74 disposed at an outer end of each extension 70. An inner portion of the groove 72 is slanted at an angle, such as about 45 degrees. This 45 degree angle improves the strength of the extension 70 and ensures that the extension is firmly held to the leg holder 34. The locking mechanism 74 has a lower wing member 76 that extends radially downwardly from the extension 70 and an upper member 78 that extends radially upwardly from the extension 70. Between the lower and upper wing members 76, 78 are side wing members 80, 82 that extend sideways from the extension 70 so that the members are perpendicular to one another. The lower wing member 76 is both longer and wider than the upper member 78 and is dimensioned to snugly fit into the relatively large upper cavity 56 of the holder 34. Similarly, the upper wing member 78 is dimensioned to snugly fit into the lower cavity 62 and the side wing members 80, 82 fit into the side cavities 58, 60. The large size of the wing member 76 adds strength to the connector 68 and ensures that the leg holder 34 is securely held to the connector 68.

Figure 4:
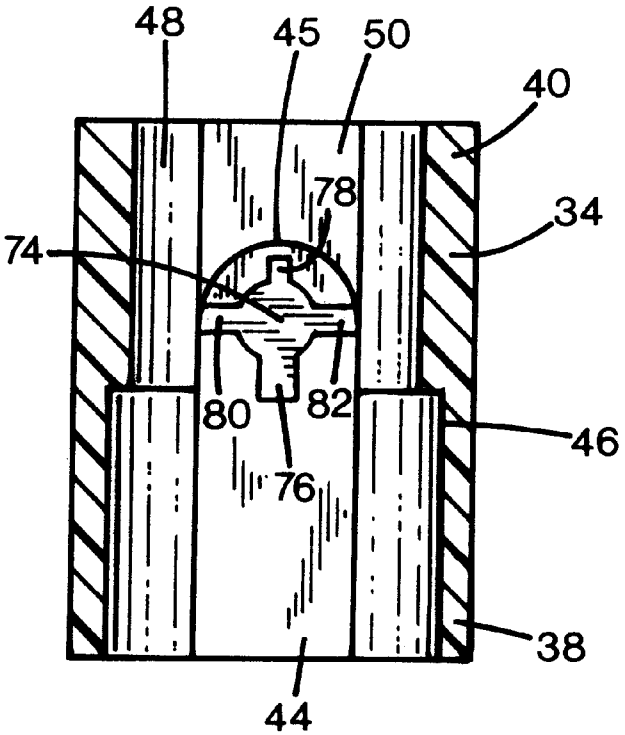
FIG. 4 is a cross-sectional side view of a portion of a leg holder of the present invention.
Figure 7:
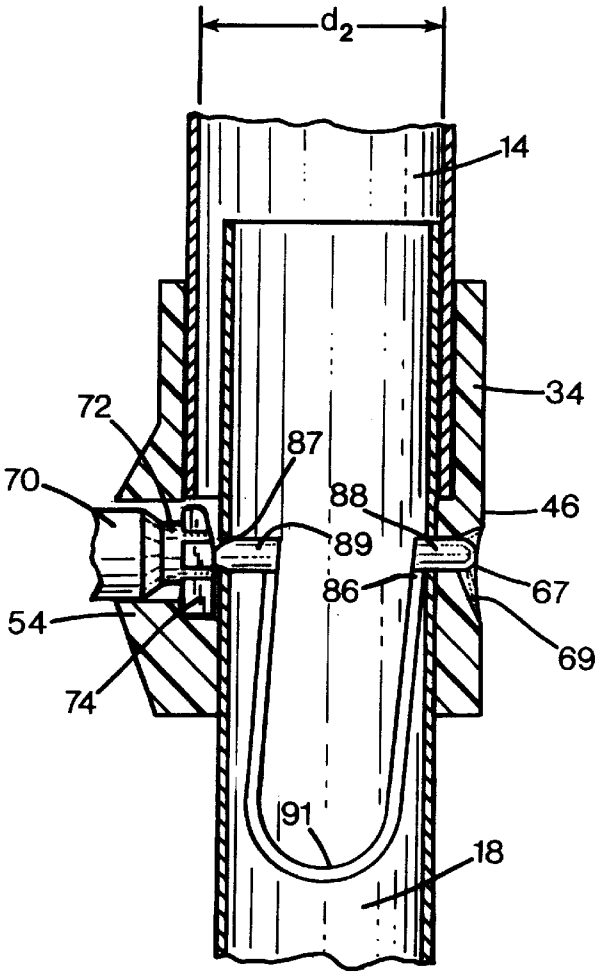
FIG. 7 is a cross-sectional side view of a lower leg inserted into an upper leg supported by a leg holder.

In this way, the extension 70 may only be inserted into the lateral opening 52 of the holder 34 (as beat shown in FIG. 4) when the lower wing member 76 is aligned with the upper cavity 56 and the upper wing member 78 is aligned with the lower cavity 62 and the side wing members 80, 82 with the side cavities 58, 60. When the extension 70 is fully inserted into the later opening 52 (as best seen in FIGS. 4 and 7), it may be rotated about 180 degrees (as beat seen in FIG. 5) because the radial groove 82 is rotatable within the lateral opening 52 while the extension wing members 76, 78, 80 and 82 are locked behind the inner wall at the lateral opening 52 of the leg holder 34. When the leg holder is turned, the lower wing member 76 and the side wing members 80, 82 may bear against the semi-circular end section 45 to provide added strength and support to the stool. By turning the leg holder 34 about 180 degrees, the upper end 38 of the leg holder 34 is turned upwardly and is ready to receive the bottom end of the upper leg 14. An important feature is that the extension 70 has a length that so dimensioned that when the extension is fully inserted into the lateral opening 52, the extensions 70 do not extend too far into the opening 36 to interfere with the lower leg 16. When the extension 70 is fully inserted, the extension is substantially flush with the flat inner wall 50.

Each lower leg 18 is an elongate hollow cylinder having one flat surface 84 extending along the lower leg 18. The lower leg 18 is dimensioned to tightly fit into the opening 36 at the lower end 40 of the leg holder 34 when the flat surface 84 is facing the flat inner wall 50 of the holder 34. The lower leg 18 has a diameter that is less than an inner diameter of the upper leg 14 so that the lower leg 18 may be inserted into the hollow upper leg 14 and the lower leg does not rub unnecessarily against the inner wall of the upper leg 14.

A pair of diametrically opposed openings 86, 87 are defined at an upper end of the lower leg 18 so that outer and inner nipples 88, 89 may extend therethrough. The nipples 88, 89 may be spring biased by a bent plastic member 91 that is biasing the nipples outwardly through the openings 86, 87. When the lower leg 18 is inserted into the lower end 40 of the holder 34, the nipple 88 is permitted to snap into the second lateral opening 67 of the holder 34. The nipple 89 is permitted to snap into a cavity that is formed between the joint member 68 and the inner wall of the holder 34. This ensures that the lower leg 18 is not inserted too far into the holder 34. The cavity in the joint member 68 should be relatively shallow so that the nipple may slip into and out the cavity without much effort. The fact that the nipple 89 is not permitted to snap into a deep cavity transfer some of the biasing force to the nipple 88 to ensure that the nipple 88 fully penetrates the second lateral opening 67. When the lower leg 18 is fully inserted into the upper leg 14 (as shown in FIG. 2) to fold the stool 10 into the collapsed position, the nipples 88, 89 prevent the lower leg 18 from sliding out of the upper leg 14 because the nipples 88, 89 bear against the inner wall of the upper leg 14. The nipples 88, 89 also ensure that the lower leg 18 is securely held to the holder 34 when a person sits on the stool 10 so that the stool does not collapse, as shown in FIG. 7. A bottom end of each lower leg 18 includes a rubber cover 90 that is attached thereto.

When the upper leg 14 is fully inserted into the opening 36 of the upper end 38 of the holder 34 and rests on the flange 46, the lowermost end of the upper leg 14 is disposed above the lateral opening 52 so that the nipples 88, 89 may extend outwardly without interfering with the upper leg 14. By pressing in the nipple 88 to disengage the nipple 88 from the second lateral opening 67, the lower leg is may either be fully inserted into the upper leg 14 to move the stool 10 into the collapsed position or the lower leg 18 may be pulled out of the holder 34 to, for example, clean the leg holder 34 or completely disassemble the stool 10.

If it is desirable to move the foldable stool from the collapsed position to the expanded position, the strap 30 is first unsnapped and the lower legs are pulled out of the upper legs until the nipples snap into the second lateral openings 67 and the lower legs 18 are separated until the seat portion 12 is stretched and the protrusions 54 of the leg holders 34 bear against one another. The leg holders 34 now form an angle that is about 35 degrees relative to a vertical line so that the rubber covers 90 stand firmly on the floor or ground. An important feature of the present invention is that all the wing members are supported by the leg holders 34 when the stool 10 is in the fully expanded position. In other words, no wing member is positioned over the asymmetrical cavities of the later opening 52.

Figure 8:
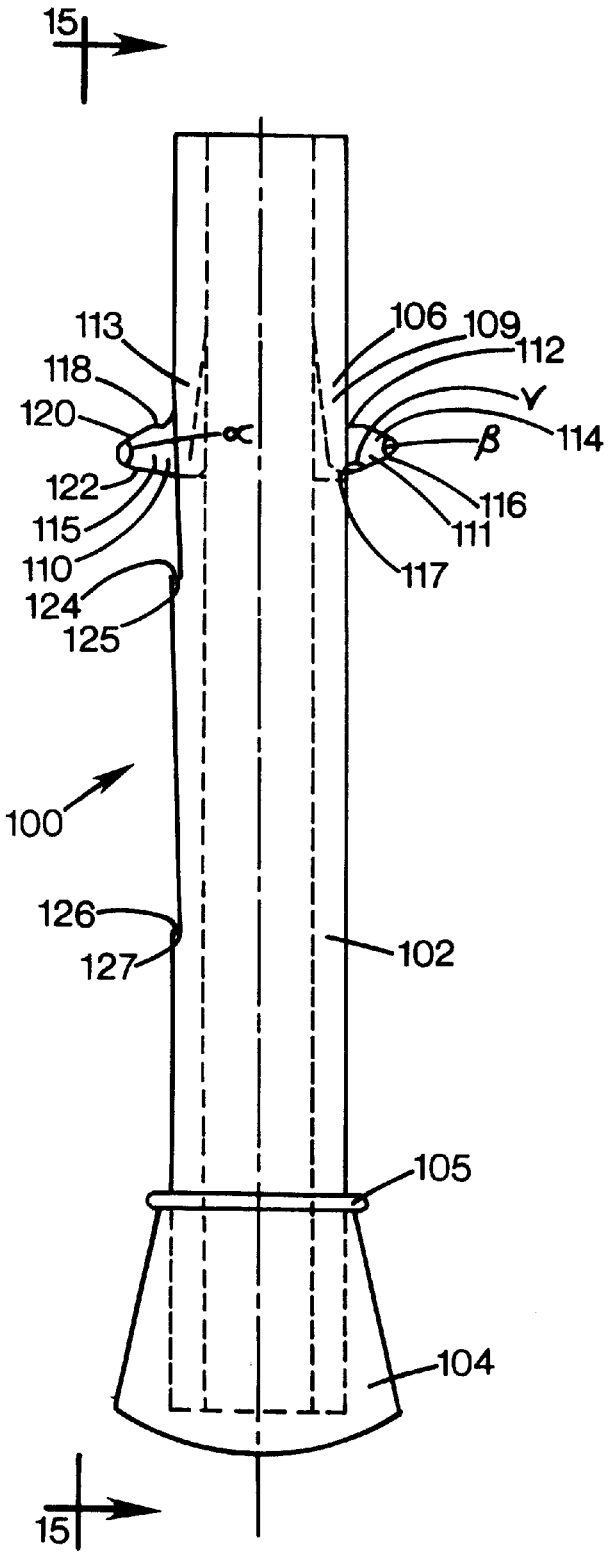
FIG. 8 is a side view of a third extension leg of the present invention.
Figure 15:
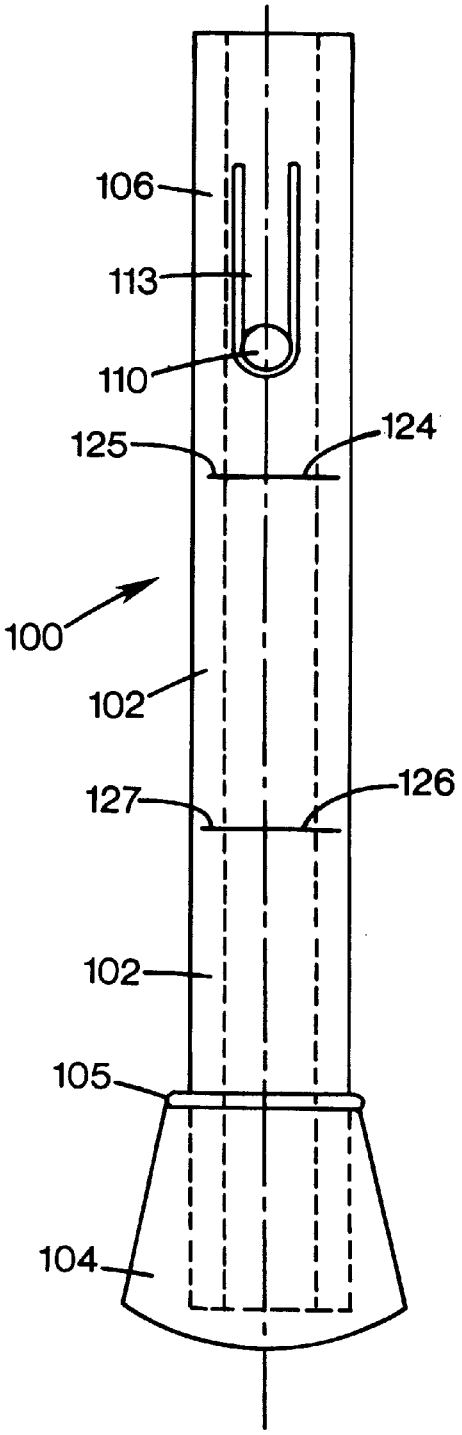
FIG. 15 is a side view along line 15—15 of FIG. 8.

With reference to FIGS. 8–16, a portion of an alternative foldable stool having a third extension leg 100 is shown. As best shown in FIG. 8, the leg 100 has a hollow tube section 102 and a rubber cover or foot 104 attached to a bottom of the tube section 102. The tube section 102 may be made of any suitable material including, but not limited to, polymer, carbon/glass fiber reinforced composite, titanium, magnesium, boron, steel and aluminum materials. One side of the leg 100 includes lateral step sections 124 and 126 defined in the tube section 102. The step section 124 has a support surface 125 that is substantially perpendicular to the longitudinal axis of the tube section 102 of the leg 100. Similarly, the step section 126 also has a support surface 127 that is substantially perpendicular to the longitudinal axis of the tube section 102 of the leg 100. An upper portion 106 of the tube section 102 has a first engagement mechanism 108 and a second engagement mechanism 110 attached thereto. The step section 124 is disposed above the step section 126 but below the second engagement mechanism 110.

The first engagement section 108 has a leg section 109 and a foot section 111. The leg section 109 is laterally bendable sideways and extends along the tube 102 and is, preferably, integral therewith. The foot section 111 is attached to or integral with the leg section 109 and may be moved towards and away from the tube 102. Preferably, the foot section 111 is part of the side wall of the tube section 102.

The foot section 111 has an upper stop surface 112 that is immediately adjacent to and extends perpendicularly from the tube section 102. The foot section 111 further has an upper downwardly sloping release surface 114 and a lower upwardly sloping release surface 116 so that an acute angle beta is formed therebetween. The lower release surface 116 extends upwardly relative to the tube section 102 so that an acute angle V is formed between the release surface 116 and the outer wall of the tube section 102. The foot section 111 also has a relatively short lower stop surface 117 at a lower end of the foot section 111. The stop surface 117 extends outwardly in a direction that is substantially perpendicular to the tube section 102.

The second engagement section 110 is, preferably, disposed diametrically opposite the first engagement section 108 on the tube section 102. The second engagement section 108 has a leg section 113 and a foot section 115. The leg section 113 is bendable sideways and extends along the tube 102 and is, preferably, integral the tube wall of the tube section 102. The foot section 115 is attached to or integral with the leg section 113 and may be moved into and away from the tube 102.

The section 110 has an upper stop surface 118 that is immediately adjacent to and extends perpendicularly from the tube 102. The foot section 115 further has an upper downwardly sloping release surface 120 and a lower stop surface 122 so that an acute angle alpha is formed therebetween. The angle beta is preferably greater than the angle alpha. It should be noted that the foot section 115 preferably lacks a lower release surface. As explained in detail below, the engagement sections 108, 110 may be used to lock the legs in a desired position when the legs of the foldable chair are both expanded and collapsed.

With reference to FIGS. 9–13, the leg 100 may be pushed into and pulled out of a leg 128 that in turn may be pushed into and pulled out of a leg 130 that is inserted into and in operative engagement with a leg holder 132. In general, the leg 130 has an inner diameter that is dimensioned to snugly receive the outer diameter of the leg 128. The leg 128 has an inner diameter that in dimensioned to snugly receive the outer diameter of the leg 100.

The leg 128 has an upper side wall opening 134 and a lower side wall opening 136 defined therein. The leg 128 also has a bottom end surface 137. The foot 104 may have an upper surface 105 that has an outer diameter that is greater than the outer diameter of the leg 128 so that the upper surface 105 may engage a bottom end surface of the leg holder 132 and provide support (best seen in FIG. 9). The openings 134 and 136 are dimensioned to snugly receive the foot sections 111, 115, respectively.

FIG. 9 shown the legs in a fully contracted or collapsed position. The leg 128 may be fully extended by pulling the leg 128 out of the leg 130 that is in operative engagement with the leg holder 132 (best seen in FIG. 10). When the leg 128 is fully extended, the seating height of the foldable chair of the present invention is about 40 centimeters. To increase the seating height, the leg 100 may be partially pulled out of the leg 128 until the release section 116 of the foot section 111 engages the opening 134 defined by the leg 128 (beat seen in FIG. 11) so that a portion of the foot section 111 protrudes through the opening 134. At the same time, the step section 126 may engage the bottom end surface 137 of the leg 128 to provide extra support. The seating height is now about 45 centimeters. The seating height may be further increased by disengaging the seat section 126 from the bottom end surface 137 and pulling out the leg 100 until the stop surface 115 engages and protrudes through the opening 136 defined by the leg 128. The step section 126 may then engage the bottom end surface 137 of the leg 128 to provide extra support. The seating height is now about 50 centimeters, as best shown in FIG. 12. This may be set as the maximum seat height. Of course, the chair of the present invention may have more than three leg segments if necessary.

An important feature of the present invention is that there is no need to press in or to manually operate the foot section 111 prior to increasing the seating height from 45 centimeters to 50 centimeters because the upwardly sloping release section 116 engages the lower portion of the opening 134 when the stop section 126 is disengaged so that the foot section 111 is automatically forced to move inside the sidewall of the leg 128 to enable the leg 128 to move within the leg 130.

The seating height may then be reduced from 50 centimeters back to 45 centimeters, if so desired, by disengaging the step section 124 from the bottom end surface 137 and permitting the release surface 120 to engage the upper portion of the opening 136 and the foot section 115 should be urged to moye inside the leg 128 by the upwardly directed force F applied to the leg 100. The leg 100 may thereafter be moved upwardly until the foot section 111 is allowed to engage the opening 134, as described in detail above, to look the leg 100 in the 45 centimeter position. The leg 100 may also be moved directly to the position where the upper surface 105 engages the bottom end surface 137 of the leg 128 without first permitting the foot sections 111, 115 to protrude through the openings 134, 136, respectively.

The foldable chair may be further contracted by disengaging the leg 128 from the leg holder 132 so that both the leg 100 and the leg 128 are fully inserted into the leg 130 (best seen in FIG. 9). Similar to the leg 100, the leg 128 may also be automatically pushed into the leg 130.

Figure 14:
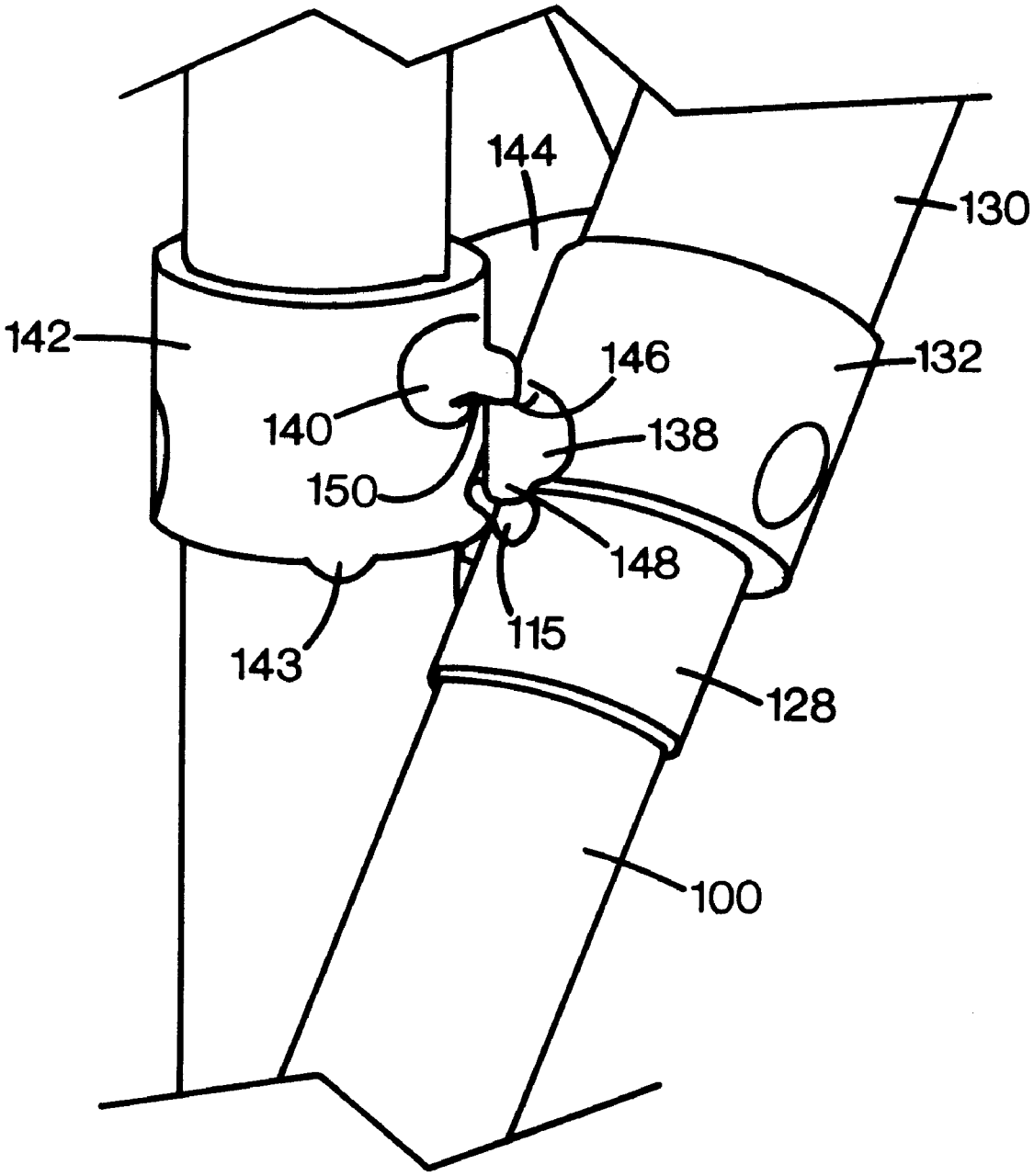
FIG. 14 is a detailed perspective view of the leg in the partially inserted position of FIG. 13 showing the engagement mechanism.

FIG. 14 shows a detailed view of the leg holder 132 when the legs 100 and 128 are pushed into the leg holder 132, as shown in FIG. 13. The leg holder 132 may have a hook 138 that extends outwardly at a lower end of the leg holder 132. The hook 138 may have a release portion 148 similar to the foot section 111. As best shown in FIG. 16, the hook 138 may also have a holder section 141 to hold the leg 100 and prevent it from undesirably falling out of the leg 128. The leg holder 132 may also have an engagement surface 143 that is adapted to engage the foot section 111 when the foldable stool is collapsed. As described in FIGS. 1–7, the leg holders may be held together by the connector 68. More particularly, the hook 138 may engage another hook 140 of a leg holder 142 that in turn may engage a third leg holder 144. The leg holders 132, 142 and 144 are, preferably, identical and only the leg holder 132 is described in detail for clarity.

The hook 138 of the leg holder 132 may have an upper hook engaging surface 146 and a lower leg engaging surface 148. The surface 146 engages a hook engaging surface 150 of the hook 140 to provide extra support to the foldable charge when the chair is expanded and ready to be used (see for example FIG. 1). A release surface 139 of the release portion 148 engages the foot section 115 as the leg 128 is being pushed inside the leg 130 to force the foot section 115 inside the leg 128. An important feature is that there is no need to press in the foot section 115 and that the foot section 115 is automatically moved inside the leg 128. In this way, the legs may be expanded and contracted by simply pulling out or pushing in the legs.

As beat shown in FIG. 13, a user may also push the leg 128 directly into the leg holder 132 while the leg 100 is expanded so that the foot section 115 engages the hook 138 and the foot section 115 is urged inside the leg 128 and the leg 128 is free to be fully pushed into the leg 130 and the leg holder 132. Similarly, a user may also push the legs completely into the leg 130 when the seat height is 45 centimeters as shown in FIG. 11 so that the foot section 111 is disengaged by the section 143.

Another important feature of the present invention is that a user may comfortably sit on the foldable chair when the legs are contracted (as shown in FIG. 9). When a higher seat height is desired, the user simply pulls out the legs to the desired length as shown in FIGS. 10–12 and as described above. If a lower seat height is desired the user may selectively push in the legs by first disengaging the legs from each step section, respectively and push the legs in to a desired position. In this way, the user may both expand and contract the legs until a desired seat height is obtained.

While the present invention has been described in accordance with preferred compositions and embodiments, it is to be understood that certain substitutions and alterations may be made thereto without departing from the spirit and scope of the following claims.

I claim:

1. A foldable stool, comprising:

a seat;

a first upper leg attached to the seat, the first upper leg defining a first opening;

a first hollow leg holder having a portion of the first upper leg inserted therein;

a second upper leg attached to the seat;

a second hollow leg holder having a portion of the second upper leg inserted therein;

a third upper leg attached to the seat;

a third hollow leg holder having a portion of the third upper leg inserted therein;

a connector attached to the first, second and third hollow leg holders;

a first lower leg in operative engagement with the first upper leg, the first lower leg being movable between an expanded position and a contracted position, a substantial portion of the first lower leg being disposable inside the first upper leg when the first lower leg is in the contracted position; and a first lower engagement mechanism attached to the first lower leg, the first lower engagement mechanism protruding radially outwardly from the first lower leg, the first lower engagement mechanism being movable between a look position and a release position, the first lower engagement mechanism being insertable through the first opening of the first upper leg to lock the first upper leg to the first lower leg, the first lower engagement mechanism having a lower release surface upwardly protruding at a first acute angle relative to the first lower leg and an upper release surface, the lower release surface and the upper release surface forming a second acute angle.

2. The foldable stool according to claim 1 wherein the first upper leg has a second opening defined therein and the first lower leg has a second lower engagement mechanism attached to the first lower leg, the second lower engagement mechanism is disposed diametrically opposed the first lower engagement mechanism and protrudes radially outwardly from the first lower leg, the second lower engagement mechanism is movable between a lock position and a release position, the second lower engagement mechanism is insertable through the second opening of the first upper leg to lock the first upper leg to the first lower leg, the second lower engagement mechanism has a lower stop surface that is perpendicular to the first lower leg and a release surface, the lower stop surface and the release surface forming a third acute angle.

3. The foldable stool according to claim 1 wherein the first lower leg has a first step section defined therein, the first step section has a first support surface that is perpendicular to the first lower leg.

4. The foldable stool according to claim 3 wherein the first lower leg has a second stop section defined therein, the second step section is disposed below the first step section, the second step section has a second support surface that is perpendicular to the first lower leg.

5. The foldable stool according to claim 1 wherein the first hollow leg holder has a downwardly extending protrusion.

6. The foldable stool according to claim 5 wherein the second hollow leg holder has an outwardly extending protrusion that is in operative engagement with the downwardly extending protrusion of the first hollow leg holder.

7. The foldable stool according to claim 6 wherein the downwardly extending protrusion of the first hollow leg holder is in operative engagement with the first engagement mechanism.

8. A foldable stool, comprising:

a seat;

a first upper leg attached to the seat;

a first hollow leg holder having a portion of the first upper leg inserted therein;

a second upper leg attached to the seat;

a second hollow leg holder having a portion of the second upper leg inserted therein;

a third upper leg attached to the seat;

a third hollow leg holder having a portion of the third upper leg inserted therein;

a connector attached to the first, second and third hollow leg holders;

a first intermediate leg in operative engagement with the first upper leg, the first intermediate leg being movable between an expanded position and a contracted position, a substantial portion of the first intermediate leg being disposed inside the first upper leg when the first intermediate leg is in the contracted position, the first intermediate leg having a first opening defined therein;

a first lower leg in operative engagement with the first intermediate leg, the first lower leg being movable between an expanded position and a contracted position, a substantial portion of the first lower leg being disposed inside the first intermediate leg when the first lower leg is in the contracted position; and a first lower engagement mechanism attached to the first lower leg, the first lower engagement mechanism protruding radially outwardly from the first lower leg, the first lower engagement mechanism being movable between a lock position and a release position, the first lower engagement mechanism being insertable through the first opening of the first intermediate leg to lock the first intermediate leg to the first lower leg, the first lower engagement mechanism having a lower release surface protruding at a first acute angle relative to the first lower leg and an upper release surface, the lower release surface and the upper release surface forming a second acute angle.

9. A method of using a foldable stool, comprising:

providing a foldable stool having a folded seat and plurality of telescoping legs attached to the folded seat, the legs being movable between a contracted and a plurality of expanded positions;

expanding the folded seat;

pulling out an intermediate leg segment to a first position;

engaging the intermediate leg segment to a first leg holder;

pulling out a lower leg segment from within the intermediate leg segment to a second position;

permitting a first engagement mechanism of the lower leg segment to protrude through a first intermediate opening defined in the intermediate leg segment;

pulling the lower leg segment to a third position; and permitting a second engagement mechanism of the lower leg segment to protrude through a second intermediate opening defined in the intermediate leg segment.

10. The method according to claim 9 wherein the step of permitting the first engagement mechanism further comprises resting a lower end wall of the intermediate leg segment on an upper step section defined in the lower leg segment.

11. The method according to claim 9 wherein the step of permitting the second engagement mechanism further comprises resting a lower end wall of the intermediate leg segment on a lower step section defined in the lower leg segment.

12. The method according to claim 9 wherein the method further comprises engaging an upper release surface of the second engagement mechanism against the intermediate leg segment and urging the second engagement mechanism inside the intermediate leg segment and pushing the lower leg segment inside the intermediate leg segment.

13. The method according to claim 12 wherein the method further comprises permitting the first engagement mechanism to protrude through the first intermediate opening.

14. The method according to claim 12 wherein the method further comprises engaging an upper release surface of the first engagement mechanism against the intermediate leg segment and urging the first engagement mechanism inside the intermediate leg segment and pushing the lower leg segment further inside the intermediate leg segment.

15. The method according to claim 9 wherein the method further comprises pushing intermediate leg segment inside an upper leg segment attached to a leg holder, engaging the second engagement mechanism against a protrusion of the leg holder and urging the second engagement mechanism inside the intermediate leg segment and pushing the intermediate leg segment further inside the upper leg segment.

* * * * *